US011781762B1

(12) United States Patent
Stevenson

(10) Patent No.: US 11,781,762 B1
(45) Date of Patent: Oct. 10, 2023

(54) AIR COOLING SYSTEM FOR BUILDING STRUCTURES WITH ATTIC

(71) Applicant: QC Manufacturing, Inc., Temecula, CA (US)

(72) Inventor: Dana Charles Stevenson, Winchester, CA (US)

(73) Assignee: QC MANUFACTURING, INC., Temecula, CA (US)

( * ) Notice: Subject to any disclaimer, the term of this patent is extended or adjusted under 35 U.S.C. 154(b) by 299 days.

(21) Appl. No.: 17/092,671

(22) Filed: Nov. 9, 2020

Related U.S. Application Data

(63) Continuation of application No. 15/063,384, filed on Mar. 7, 2016, now Pat. No. 10,830,464.

(60) Provisional application No. 62/128,717, filed on Mar. 5, 2015.

(51) Int. Cl.
*F24F 7/02* (2006.01)
*F24F 7/007* (2006.01)
*F24F 11/00* (2018.01)

(52) U.S. Cl.
CPC ..... *F24F 7/025* (2013.01); *F24F 7/007* (2013.01); *F24F 11/0001* (2013.01); *F24F 2221/14* (2013.01); *F24F 2221/16* (2013.01)

(58) Field of Classification Search
CPC ..... F24F 7/025; F24F 7/007; F24F 11/0001
USPC ..... 454/349
See application file for complete search history.

(56) References Cited

U.S. PATENT DOCUMENTS 416,405 A 12/1889 Fouquet
1,855,997 A 4/1934 Yant
2,011,421 A 8/1935 Searles
2,191,774 A 2/1940 Reed
2,218,348 A 10/1940 Boyer
2,225,885 A 12/1940 Penman
2,278,581 A 4/1942 Macdougald
2,299,833 A 10/1942 Mader
2,349,627 A 5/1944 Kemmer et al.
2,464,000 A 3/1949 Schild
(Continued)

FOREIGN PATENT DOCUMENTS

AU 9333942 A 9/1993
JP 57-062341 A 4/1982
(Continued)

OTHER PUBLICATIONS

Alt, H.G., "Air Conditioning Simplified"; Domestic Engineering vol. 143, No. 3, p. 76; 1934, Reprinted from "Comfort Cooling with Attic Fans" by G.B. Helmrich and G.H. Tuttle.
(Continued)

*Primary Examiner* — Allen R. B. Schult
(74) *Attorney, Agent, or Firm* — Knobbe, Martens, Olson & Bear LLP

(57) ABSTRACT

A fresh-air cooling system for a building structure having an unvented attic is provided. The system provides airflow pathways that allow outside air to be drawn through, and discharged from, a building having an unvented attic. Dampers with a low thermal conductivity regulate airflow through the building structure. The system allows a whole house fan to cool a building having an unvented attic. The system seals or otherwise alters airflow pathways through the building structure in order to reduce heat transfer between the building and the outside environment when the cooling system is not in use.

31 Claims, 14 Drawing Sheets

(56) References Cited

U.S. PATENT DOCUMENTS

| | | | | |
|---|---|---|---|---|
| 2,544,379 | A | 3/1951 | Davenport | |
| 2,612,831 | A | 10/1952 | Lohman, Jr. | |
| 2,684,621 | A | 7/1954 | Cook | |
| 3,199,433 | A | 8/1965 | Bosma, Jr. et al. | |
| 3,330,379 | A | 7/1967 | Cook | |
| 3,698,158 | A | 10/1972 | Kinnebrew | |
| 3,738,621 | A | 6/1973 | Anderson | |
| 4,176,587 | A | 12/1979 | Cox | |
| 4,261,255 | A | 4/1981 | Anderson et al. | |
| 4,318,518 | A | 3/1982 | Davis | |
| 4,372,196 | A | 2/1983 | Henderson | |
| 4,375,183 | A | 3/1983 | Lynch | |
| 4,385,550 | A | 5/1983 | Steiner et al. | |
| 4,502,467 | A | 3/1985 | Smith | |
| 4,662,268 | A | 5/1987 | Beavers | |
| 4,776,385 | A | 10/1988 | Dean | |
| 4,939,986 | A | 7/1990 | Turner | |
| 4,951,480 | A | 8/1990 | Brence | |
| 4,977,818 | A | 12/1990 | Taylor et al. | |
| 5,092,520 | A | 3/1992 | Lestage | |
| 5,306,207 | A | 4/1994 | Court | |
| 5,353,601 | A | 10/1994 | Palmer | |
| 5,620,368 | A | 4/1997 | Bates et al. | |
| 5,720,561 | A | 2/1998 | Yoshizawa et al. | |
| 5,947,158 | A | 9/1999 | Gross et al. | |
| 5,957,506 | A | 9/1999 | Stepp | |
| 5,966,953 | A | 10/1999 | Murr et al. | |
| 5,979,167 | A | 11/1999 | Kochavi et al. | |
| 6,203,422 | B1 | 3/2001 | Rosal et al. | |
| 6,267,667 | B1 | 7/2001 | Fikes | |
| 6,287,191 | B1 | 9/2001 | Barker, II | |
| 6,302,932 | B1 | 10/2001 | Unger et al. | |
| 6,322,443 | B1 | 11/2001 | Jackson | |
| 6,328,776 | B1 | 12/2001 | Shanks et al. | |
| 6,439,466 | B2 * | 8/2002 | Fikes | F24F 7/007 236/11 |
| 6,450,414 | B1 | 9/2002 | Dartnall et al. | |
| 6,537,146 | B1 | 3/2003 | Haynes | |
| 7,001,265 | B1 | 2/2006 | Beaty | |
| 7,497,774 | B2 | 3/2009 | Stevenson et al. | |
| 7,798,418 | B1 | 9/2010 | Rudd | |
| 8,079,898 | B1 | 12/2011 | Stevenson | |
| 10,830,464 | B1 | 11/2020 | Stevenson | |
| 2002/0124992 | A1 | 9/2002 | Rainer et al. | |
| 2004/0020222 | A1 | 2/2004 | Miwa | |
| 2005/0102913 | A1 | 5/2005 | Gilleran | |
| 2006/0061313 | A1 * | 3/2006 | Fitzgibbon | E05F 15/668 318/452 |
| 2006/0154596 | A1 | 7/2006 | Meneely, Jr. | |
| 2007/0227721 | A1 | 10/2007 | Springer et al. | |
| 2009/0321039 | A1 | 12/2009 | Therrien et al. | |
| 2010/0300645 | A1 | 12/2010 | Glover | |
| 2011/0259559 | A1 | 10/2011 | Gheyri | |
| 2013/0165037 | A1 | 6/2013 | Casey | |
| 2014/0081458 | A1 | 3/2014 | Potter | |

FOREIGN PATENT DOCUMENTS

| | | | |
|---|---|---|---|
| JP | 58-208527 | A | 5/1983 |
| JP | 58-208528 | A | 5/1983 |
| JP | 59-041734 | A | 8/1984 |
| JP | 09-242206 | A | 9/1997 |
| JP | 2000-002457 | A | 1/2000 |

OTHER PUBLICATIONS

Print-Out of Quietcoolfan.com website, Sep. 2003.

Quiet Cool Online Publication—Quiet Cool Whole House Fans, dated Aug. 20, 2006, located at http://web.archive.org/web/20060820095737/http://www.quietcoolfan.com/ (with Examiner's an notations).

* cited by examiner

AIR COOLING SYSTEM FOR BUILDING STRUCTURES WITH ATTIC

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field

The disclosure relates generally to cooling systems for building structures, such as those having sealed envelope attics.

Description of the Related Art

Traditionally, homes have been built with a ventilated attic to help keep the house cooler in the summer and discourage moisture buildup in the attic year-round. In a vented attic, warm attic air rises to the peak of the roof and escapes the attic through a vent near the peak of the roof. The warm air escaping the attic creates a suction force that draws outside air into the attic through other vents (e.g., soffit vents). In this way, attic air is circulated in a vented attic.

In cold climates, attic ventilation helps maintain a cold roof temperature, which avoids ice dams created by melting snow. In hot climates, attic ventilation can help expel solar heated hot air from the attic to lessen the cooling load. Because the air in a vented attic is usually warmer or colder than the air in the living space, vented attics have a layer of insulation between the attic floor and the ceiling of the living space to limit heat transfer from the vented attic to the living space.

Vented attics can be effective, as long as the ceiling deck is well sealed and insulated. But complex roof designs make it difficult to construct a vented roof assembly with an airtight interior barrier at the ceiling plane. Also, it is becoming more common to locate mechanical systems and ductwork in attic spaces. Such ductwork is often leaky or less well insulated, resulting in energy losses and moisture build up in the attic as air flows between the conditioned living space and the vented attic.

More recently, building codes have been modified to allow the construction of unvented or sealed attics (sometimes referred to as high-performance or conditioned attics). In an unvented attic, air-impermeable insulation is applied directly to the underside of the structural roof deck and is tied into the insulation located in the walls so that the roof system becomes part of the insulated building enclosure. Unvented roof assemblies can improve energy efficiency of a home, reduce mold and other contaminants from entering the home, and moderate the temperature differences imposed on ductwork and mechanical systems located within the attic. However, most cooling systems designed for a building structure having an unvented attic rely on air-conditioning systems that use a refrigeration cycle to cool the air. Such systems can be expensive to operate and limit the flow of fresh air into the building. What is needed is a fresh-air cooling system that can be used to regulate temperature in a building having an unvented attic.

SUMMARY

The systems, methods and devices described herein have innovative aspects, no single one of which is indispensable or solely responsible for their desirable attributes. Without limiting the scope of the claims, some of the advantageous features will now be summarized.

Disclosed herein are embodiments of a temperature regulating system for a building having a sealed attic, otherwise known as an unvented attic, a conditioned attic, or a high-performance attic. The system comprises a fan, an air intake, a vent, a damper, and a flow path for circulating outside air through the building structure. The system allows the flow path to be modified depending on the temperature conditions of the living space, the attic, and/or the outside environment. The system comprises thermally-insulated dampers that seal the vents, and/or the air intakes, and/or the air inlets to limit heat transfer between the attic, the living space, and/or the outside environment.

In some aspects, the system comprises a whole house fan system and at least one insulated mechanical damper, the mechanical damper creating a sealable vent in the unvented attic of the building, wherein the whole house fan and the at least one mechanical damper are electronically and/or electrically connected in order to allow air to flow through the building.

In some embodiments, the system can further comprise a power ventilator. In some embodiments, a power ventilator may not be used. In some embodiments, a plurality of mechanical dampers can be used. In some embodiments, a plurality of power ventilators can be used. In some embodiments, a plurality of whole house fans can be used. In some embodiments, the plurality of mechanical dampers can create a plurality of vents. In some embodiments, some of the vents can incorporate power ventilators whereas other vents do not incorporate power ventilators. In some embodiments, the system can further comprise a thermostat. In some embodiments, the thermostat can control one or more of the vents, the dampers, the whole house fans, the power ventilators, the air intakes, and/or the air inlets. In some configurations, the system can include an air-conditioning system.

In some aspects, the fresh-air cooling system includes a mechanical damper that has an open configuration that allows air to flow through the vent, the air intake, and/or the air inlet. The mechanical damper has a closed configuration that restricts airflow through the vent, the air intake, and/or the air inlet. The mechanical damper has an R-value of between about R4 and R50 when the mechanical damper is in the closed configuration.

In some aspects, the system has an inlet communicating between the unvented attic and the living space of the building. The system has a duct connecting the inlet to a vent that communicates to the outside environment. The duct is configured to prevent air that is in the unvented attic and outside of the duct from entering the vent. In some aspects, the duct has an R-value of between about R4 and R50. In some configurations, a whole house fan is disposed at least partially outside of an unvented attic of the building. In some embodiments, the system has an air intake communicating between the unvented attic and an atmosphere outside of the building. The system has an opening disposed above the air intake, the opening communicating between the attic and the atmosphere outside of the building. In some configurations, the system has an inlet damper configured to control air flow through the air intake. The system has an outlet damper configured to control air flow through the opening. In some embodiments, the system has a first motor that moves the inlet damper to allow or block air flow through the air intake. The system has a second motor that moves the outlet damper to control air flow through the opening. In some embodiments, a thermostat controls the operation of the first and second motors.

In some aspects, a method of regulating the temperature of a building structure having a sealed attic is provided. The method comprises opening a damper to establish a first flow path between the sealed attic and an atmosphere outside of the building structure, opening an air intake to establish a second flow path between the atmosphere and a space within the building structure, powering a whole house fan to create a static negative pressure in the space within the building structure, and drawing into the space air from the atmosphere, the temperature of the air from the atmosphere being less than the temperature of the space, thereby cooling the building structure.

In some aspects, a vent assembly comprises a whole house fan, a motor housing surrounding the whole house fan, and a flange outwardly extending from the motor housing, an interface between the flange and the motor housing being watertight. In some embodiments, the vent assembly has a tubular duct having a first end attached to a base portion of the motor housing and an air inlet attached to a second end of the tubular duct. In some configurations, the vent assembly has a damper disposed between the air inlet and the motor housing. The damper is movable between an open configuration and a closed configuration. The open configuration of the damper allows air flow between the inlet and the motor housing. The closed configuration restricts air flow between the inlet and the motor housing. In some embodiments, the damper has an R-value of between about R4 and R50 when the damper is in the closed configuration.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings.

DETAILED DESCRIPTION

Figure 1:
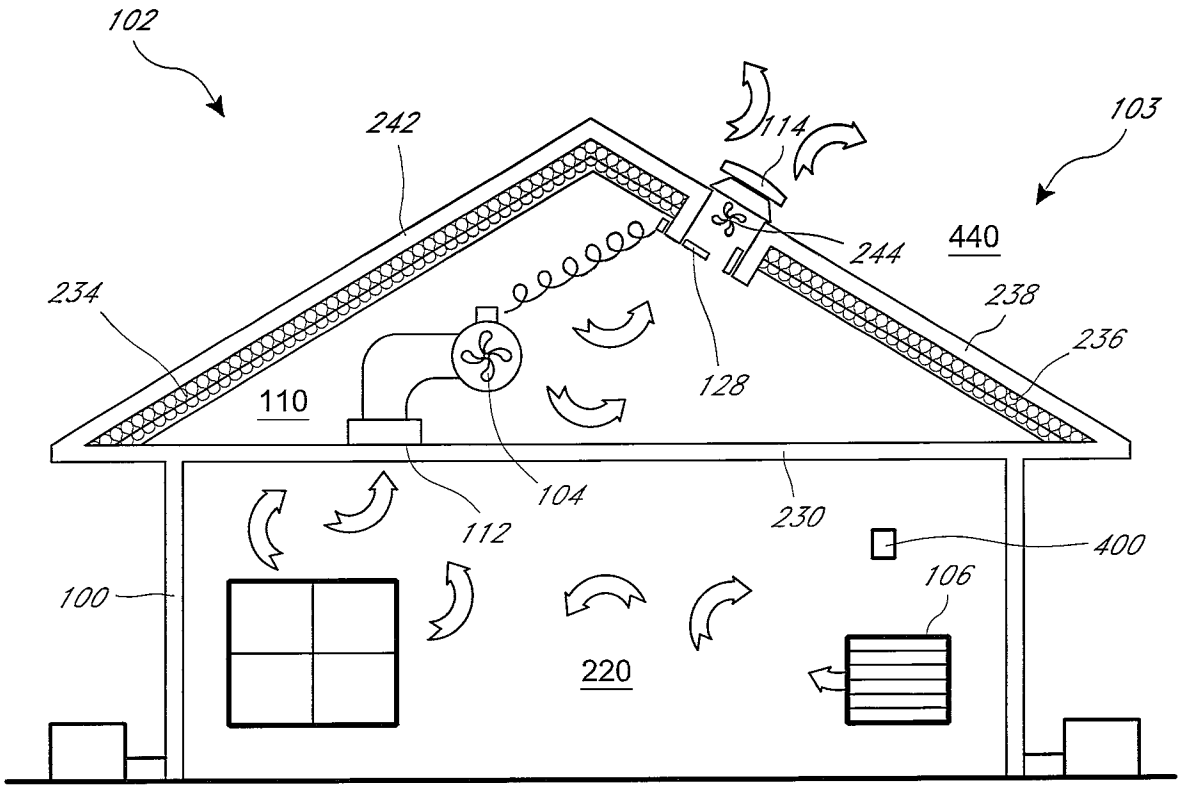
FIG. 1 illustrates a partial sectional view of a building structure showing an embodiment of a fresh air cooling system.

Embodiments of systems, components and methods of assembly and manufacture will now be described with reference to the accompanying figures, wherein like numerals refer to like or similar elements throughout. Although several embodiments, examples and illustrations are disclosed below, it will be understood by those of ordinary skill in the art that the inventions described herein extends beyond the specifically disclosed embodiments, examples and illustrations, and can include other uses of the inventions and obvious modifications and equivalents thereof. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

Certain terminology may be used in the following description for the purpose of reference only, and thus are not intended to be limiting. For example, terms such as "above" and "below" refer to directions in the drawings to which reference is made. Terms such as "front," "back," "left," "right," "rear," and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specifically mentioned above, derivatives thereof, and words of similar import.

Embodiments of the present disclosure provide for an automated fresh-air cooling system. In some aspects, the present disclosure is directed to a fresh-air cooling that allow a whole house fan to cool a building having an unvented attic. The apparatuses, methods, and cooling systems herein disclosed provide airflow pathways that allow outside air to be drawn through, and discharged from, a building having a sealed or unvented attic. The cooling system of the present disclosure include features that can seal or otherwise alter airflow pathways through the building structure in order to reduce heat transfer between the building and the outside environment when the cooling system is not in use. As described in more detail below, the cooling systems of the present disclosure can be switched between two or more different configurations, thereby allowing airflow and/or heat transfer between the building structure and the outside environment to be regulated.

FIG. 1 discloses a fresh-air cooling system 100 for a building structure 100 with an unvented or sealed attic 110. Unvented or sealed attic is an attic that is constructed without ventilation and has insulation placed in contact with the roof sheathing instead of the attic floor, and the attic space is air-sealed. Referring to FIG. 1, in the conditioned or unvented attic 110, air-impermeable insulation 234 is applied to the underside 236 of the roof deck 238 and is tied to the wall insulation 240 (shown in FIG. 3) of the building structure 100. This new insulation position creates a conditioned, unvented attic space, as opposed to the previously used vented attics. Typically, in this new style there are no vents leading outside of the attic through the roof 242. Accordingly, buildings having an unvented attic 110 often rely on cooling systems that use a refrigeration cycle to cool the air that is enclosed within the building structure 100.

Fresh-air cooling systems 102 can cool a building structure 100 by drawing cooler outside air through the building structure 100. As shown in FIG. 1, a fresh-air cooling system 102 can establish an airflow pathway (shown as thick arrows) that draws outside air into the living space 220 through an air intake 106. The airflow pathway can push air out of the building structure 100 through a vent 114. The fresh-air cooling system 102 can include a whole house fan 104 and/or a power ventilator 244 to drive air along the airflow pathway. As discussed in more detail below, the fresh-air cooling system 102 can include an integrated thermostat 400 that can modify or adjust the airflow pathway. In some variants, the integrated thermostat 400 adjusts the airflow pathway based on information received by the integrated thermostat 400. For example, the integrated thermostat 400 can adjust the airflow pathway based on temperature and/or humidity readings of the living space 220, the unvented attic 110, and/or the outside environment 440.

Whole house fans 104 can be used in the fresh-air cooling system 102 of the present disclosure. Traditional whole house fans discharge into the attic and are therefore useless for cooling a building having a sealed attic 110 because sealed attics 110 provide no pathway for the discharged air to exit the building structure 100. The fresh-air cooling systems 100 of the present disclosure allow a whole house fan 104 to be used in a building structure 100 having an unvented attic 110. The cooling systems 102 disclosed herein can include vents 114, air intakes 106, air inlets 112, dampers 128, whole house fans 104, and power ventilators 244 that establish and control airflow pathways for circulating air through a building having a sealed attic 110. Additionally, the fresh-air cooling systems 102 of the present disclosure can include features that reduce heat transfer between the building structure 100 and the outside environment 440. In some variants, the fresh-air cooling systems 102 disclosed herein include features that reduce heat transfer between the unvented attic 110 and the living space 220.

With continued reference to FIG. 1, disclosed herein are whole house temperature control systems that can be incorporated into the new style of sealed, unvented attics. The fresh-air cooling systems 102 of the present disclosure can regulate airflow through the unvented building structure 100. The cooling system 102 herein disclosed can switch between multiple configurations, allowing the cooling system 102 to regulate airflow and/or heat transfer between the outside environment 440, the attic 110, and/or the living space 220. For example, the cooling systems 102 can have a first configuration that provides an airflow pathway from the living space 220 to the outside environment 440. The cooling systems 102 can be switched to a second configuration that limits airflow and/or heat transfer between the building structure 100 and the outside environment 440. In some embodiments, the cooling systems 102 can have a third configuration that limits airflow and/or heat transfer between the attic 110 and the living space 220. In certain variants, the cooling systems 102 can have a fourth configuration that limits airflow and/or heat transfer between the attic 110 and the outside environment 440. In some configurations, the cooling system 102 can provide an airflow pathway between the living space 220 to the outside environment 440 while maintaining the unvented attic 110 sealed from the outside environment 440. In some variants, the cooling system 102 can allow, at least temporarily, airflow between unvented attic 110 and the outside environment 440.

In some embodiments, mechanical dampers 128 can be used regulate the airflow and/or heat transfer of the fresh air cooling system 102. The mechanical dampers 128 can be used on one or more components of the fresh-air cooling system 102. For example, a mechanical damper 128 can control air flow through an air intake 106, an air inlet 112, a duct 120, a vent 114, and/or an evaporator 404 (discussed below). As discussed below, the mechanical dampers 128 can include features to reduce conductive, convective, and/or radiative heat transfer between the building structure 100 and the outside environment. The mechanical dampers 128 can be opened and closed by a motor and/or controlled by an integrated thermostat 400.

In some embodiments, the mechanical dampers 128 can have various different shapes such as round, triangular, half round, and the particular shape of the dampers are not limiting. Further, the mechanical dampeners 128 can have a size ranging from approximately half a square foot to 20 square feet, though the size is not limiting. In some embodiments, the mechanical dampeners 128 can have an opening rate of 1 second, 10 seconds, 30 seconds, 1 minute, 5 minutes, 10 minutes, or 20 minutes, and the rate is not limiting. If more than one mechanical dampener 128 is used, the dampeners can have different or the same rates of opening. By having mechanical dampers 128, and thus providing an exit out of the unvented attic 110, a whole house fan 104 can be used in the building 100. The mechanical dampers 128 can be configured to be opened and closed in conjunction with the operation of the whole house fan 104 and/or power ventilator 244. In some embodiments, the dampers 128 can seal the unvented attic 110 when closed, thus maintaining the unvented space. In some embodiments, a single mechanical damper 128 can be used. In some embodiments, a plurality of mechanical dampers 128 can be used. Different mechanical dampers 128 can be used at different locations on the roof in some embodiments.

In some embodiments, the whole house fan 104 can include fan blades actuated by a motor to expel the internal air out of the building structure 100. In certain variants, the motor is a variable rpm motor. In some embodiments, the motor can spin at between about 200-4000 revolutions per minute (rpm) and more preferably between about 1500-1600 rpm and about 1550 rpm. In another implementation the motor 116 is between about 1000-1300 rpm and preferably about 1050 rpm. The air flow capacity of the whole house fan 104 can be between about 500-8000 cubic feet per minute (cfm), more preferably between about 2750-4500 cfm, more preferably about 2750 cfm, more preferably about 1500 cfm. In some embodiments, the air flow capacity can be about 2465 cfm. In some embodiments, the air flow capacity can be about 3190 cfm. In some embodiments, the air flow capacity can be about 4712 cfm. In some embodiments, the air flow capacity can be about 2457 cfm. In some embodiments, the air flow capacity can be about 1104 cfm. In some embodiments, the air flow capacity can be about 8000 cfm. In some embodiments, the whole house fan 104 can generate a static negative pressure within the building structure 100. In some configurations, the whole house fan 104 can generate a static negative pressure within the living space 220 of the building structure 100.

Figure 2:
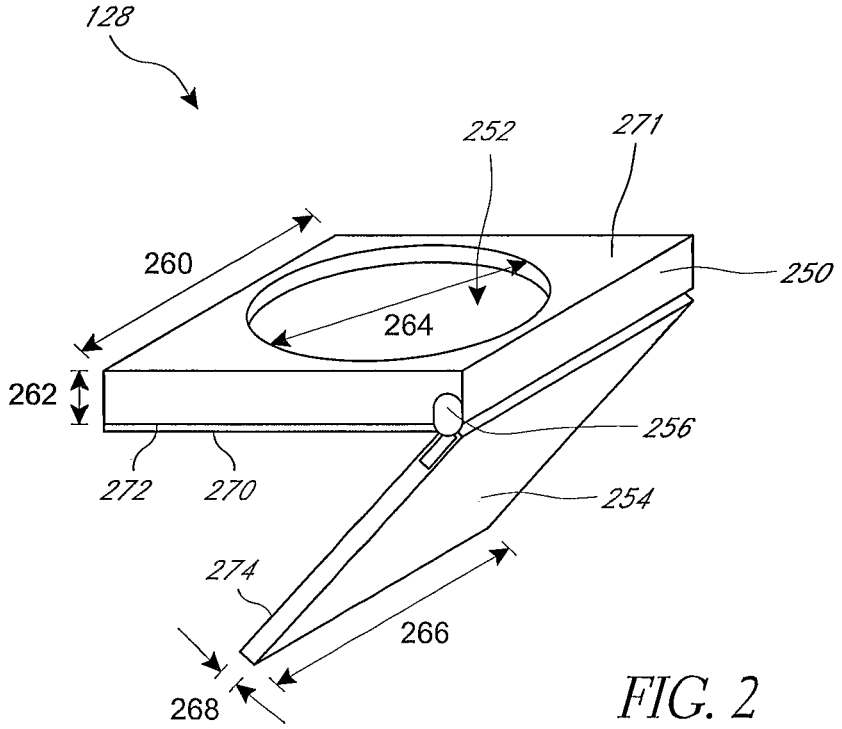
FIG. 2 depicts an embodiment of a damper.

FIG. 2 depicts a non-limiting, illustrative embodiment of a damper 128. The damper 128 can be adapted to control air flow through a vent 114, an air intake 106, an air inlet 112, a whole house fan 104, and/or a power ventilator 244 of a fresh-air cooling system 102. In some variants, the damper 128 controls air flow through a vent 114 that connects an unvented attic 110 to the outside environment 440. The damper 128 can have a housing 250 that surrounds an opening 252. The opening 252 can be sized to receive at least a portion of the vent 114. In some embodiments, the opening 252 is sized to receive the vent 114 into the opening 252 and to form a substantially air-tight seal with the vent 114. The damper 128 can include a door 254. The door 254 can be coupled to the housing 250 by a hinge 256, thereby allowing the door 254 to move between an open configuration, in which the door 254 uncovers the opening 252, and a closed configuration, in which the door 254 covers the opening 252. A motor (not shown) can control the movement of the door 254, as described above for other embodiments of the damper 128.

In some variants, the damper 128 has a plurality of hinged shutters or blades that cover the opening 252 instead of the unitary door 254 shown in the illustrated embodiment. In some embodiments, the blades or door 254 can be moved to a closed position by gravity when the fan 104 or power ventilator 244 is not operating, thereby covering the opening 252. When the fan 104 or power ventilator 244 is operating, air flow generated by the fan 104 and/or ventilator 244 can force the blades or door 254 to open, thereby allowing air to flow through the opening 252. In some variants the blades or door 254 can be opened and closed by mechanical means (e.g., a motor). In a preferred embodiment, the blades or door 254 are made of an insulating material so that when they are closed, they substantially prevent air from passing through the opening 252 and/or prevent heat conduction through the damper 128. The insulating R value through the damper can be R4 to R50 with closed dampers and more preferably about 4.2, more preferably about 5 and more preferably about 6.8.

The damper 128 can be designed to reduce conductive, convective, and/or radiative heat transfer between the unvented attic 110 and the living space 220, between the unvented attic 110 and the outside environment 440, and/or between the living space 220 and the outside environment 440. The blades or door 254 of the damper 128 can include a material having a low thermal conductivity (e.g., glass, wool, cork, polystyrene foam, vacuum insulated panel). In some variants, the blades or door 254 can have an evacuated core or other features known in the art to minimize heat conduction through the blade or door 254. The damper 128 can include a coating that reflects incident radiation, and/or minimizes absorbed radiation, and/or reduces transmitted radiation. In some embodiments, the damper 128 can be configured to have an R-value of between about R4 and about R50 when the damper 128 is in the closed configuration.

In the illustrated embodiment, the housing 250 is square, has a side length 260 of about 27 inches, a thickness 262 of about 2 inches, and a circular opening 252 with a diameter 264 of about 22 inches. The illustrated embodiment has a door 254 that is square with a side length 266 of about 24 inches and a thickness 268 of about 1 inch. However, the damper 128 can have other configurations. For example, the housing 250, opening 252, and/or door 254 can be bigger, smaller, thicker, or thinner than the illustrated embodiment. Additionally, the housing 250 and/or door 254 need not be square, and the opening 252 need not be circular. The housing 250 and the door 254 can be made of the same material or can be made of different materials. In some embodiments, the housing 250 is made of sheet metal, while the door 254 is made of a material having a low thermal conductivity. In some embodiments, the housing 250 can include or be made from a material having a low thermal conductivity.

The damper 128 can have a top surface 271 that attaches to the roof sheathing of the building structure 100. In some variants, the damper 128 can include a rubber seal 270 that helps create a substantially airtight seal between the door 254 and the housing 250 when the door 254 is in the closed position. The seal 270 can be disposed on a bottom face 272 of the housing 254. In some embodiments, the seal 270 can be disposed on a top face 274 of the door 254. In some variants, the damper 128 can include a seal 270 on both the top face 274 of the door 254 and the bottom face of the housing 254. The seal 270 can be made of rubber or other suitable materials (e.g., thermal insulating foam).

In some embodiments, the damper 128 can be partially closed to reduce the rate and/or pathway of air flow in the home. The damper 128 can include a mechanical or electrical switch sensor to indicate position of the damper door 254. The switch sensor can communicate with the integrated thermostat 400 to provide fine tuning of the airflow rate to adjust the atmospheric comfort levels within the building. Further, the switch sensor can provide for a visual or auditory cue to a user to communicate the position of the damper blades door 254. In some embodiments, the cooling system 102 can modify position of the damper 128 in order to alter airflow rate and/or pathway in order to reduce heat transfer between the building structure 100 and the outside environment.

Figure 3:
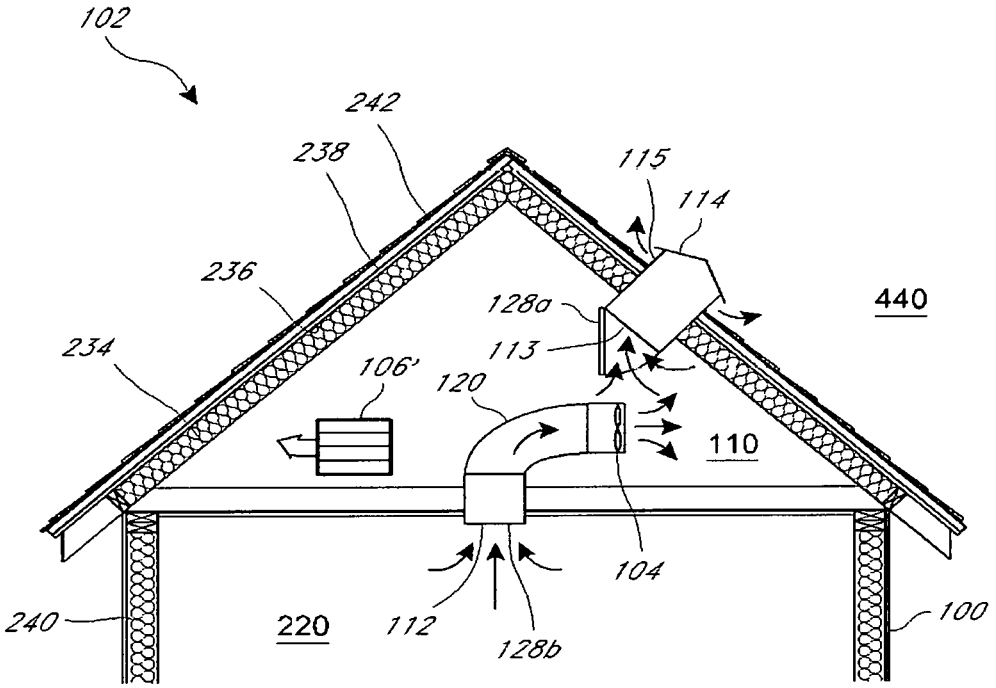
FIG. 3 is a schematic illustration of an embodiment of the cooling system of the present disclosure.

Referring to FIG. 3, the fresh-air cooling system 102 can include a vent 114 that provides a pathway for air to exit the unvented attic 110 through the roof 242 of the building structure 100. When the whole house fan 104 is operating, the cooling system 102 of the illustrated embodiment establishes an airflow pathway from the living space 220, to the unvented attic 110, and then to the outside environment 440. In this way, the fresh-air cooling system 102 establishes an airflow pathway through which outside air is pulled into the living space 220. The living space air is drawn into the unvented attic 110. The attic air mixes with air that is pulled from the living space 220 and discharged into the unvented attic 110. The air is then discharged from the unvented attic 110 to the outside environment 440 through the vent 114. This configuration of the cooling system 102 can help cool the unvented attic 110 and reduce heat conduction to the living space 220 from the floor of the unvented attic 110 and the ceiling of the living space 220. This configuration of the cooling system 102 also reduces convective heat transfer to the living space 220 and/or the unvented attic 110 because airflow is in the direction from the living space 220 to the attic 110 and then to the outside environment 440. When the living space 220 reaches a desired temperature, the fresh-air cooling system 102 can deactivate the fan 104 and/or power ventilator 244 and close the dampers 128 to reduce heat transfer from the living space 220 and/or from the attic 110.

Because the attic air in an unvented attic 110 is susceptible to solar heating, the fresh-air cooling system 102 can include features that reduce attic heating and the subsequent potential heat transfer from the attic 110 to the living space 220. For example, the fresh-air cooling system 102 can include a vent 114 near the apex of the roof 242 that communicates between the unvented attic 110 and the outside environment. The fresh-air cooling system 102 can include an air intake 106' near the attic floor that communicates between the unvented attic 110 and the outside environment 440. The fresh-air cooling system 102 can open the vent 114 and the air intake 106', at least temporarily, to effectively convert the unvented attic 110 into a vented attic, thereby reducing the temperature of the air in the attic.

In some embodiments, the fresh-air cooling system 102 can tailor the airflow pathway through the building 100 depending on the temperature and/or humidity conditions in the building 100 and outside environment 440. For example, if the fresh-air cooling system 102 detects that the living space 220 is at a comfortable temperature but that the unvented attic is warm, the fresh-air cooling system can be configured to open the first damper 128*a*, at least partially, to allow hot attic air 110 to escape the building structure 100, while maintaining the second damper 128*b* closed. In this way, the fresh-air cooling system 102 may establish an airflow pathway between the unvented attic 110 and the outside environment 440, while restricting airflow between the unvented attic 110 and the living space 220. This modification of the airflow pathway can allow the fresh-air cooling system 102 to reduce heat conduction from the unvented attic 110 and the living space 220.

In some embodiments, the cooling system 102 can include an air intake 106' that is positioned near the floor of the attic 110 and communicates between the attic 110 and the outside environment 440. The fresh-air cooling system 102 can open the air intake 106' near the attic floor and open the first damper 128*a* while maintaining the second damper 128*b* closed, thereby effectively converting the unvented attic 110 into a vented attic. The air intake 106' near the attic floor can include a thermally insulated damper 128, as described above. In some embodiments, the cooling system 102 can include a logic circuit that determines whether to open the first damper 128*a* based on the temperature of the attic, the living space, and/or the outside environment 440.

Figure 4:
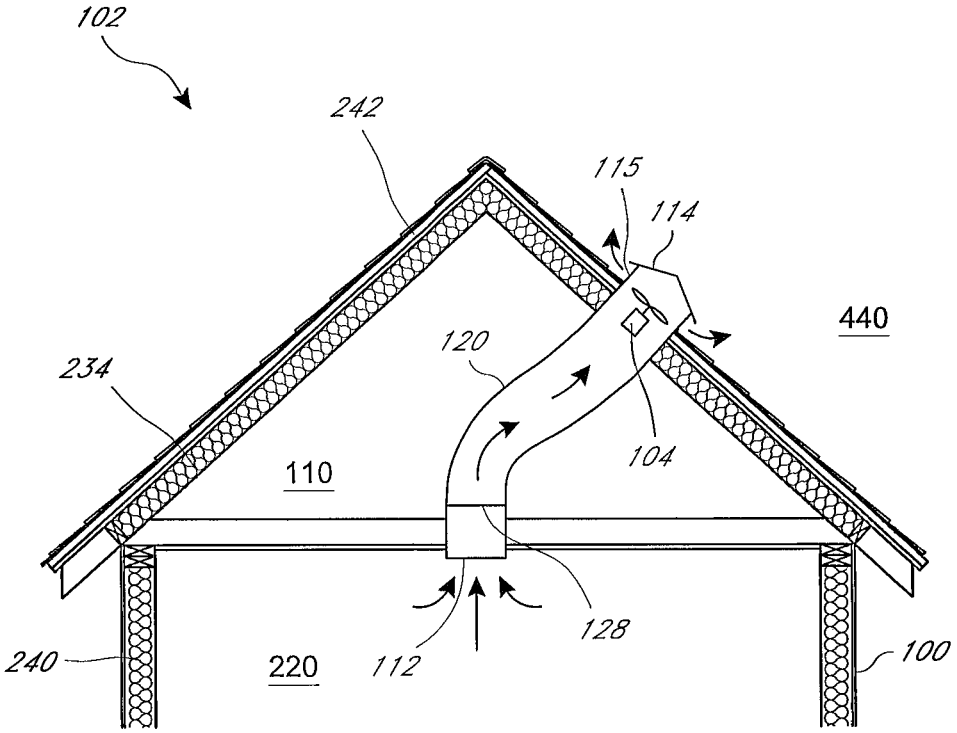
FIG. 4 is a schematic illustration of an embodiment of the cooling system of the present disclosure.

FIG. 4 shows another embodiment of the fresh-air cooling system 102 for use in a building structure 100 having a sealed or conditioned attic 110. In the illustrated embodiment, a duct 120 connects an air inlet 112 to a whole house fan 104 that is disposed within a vent 114 that has an outlet 115 outside of the roof 242. In some variants, a power ventilator 244 can be installed within the vent 114 in place of the whole house fan 104. In the illustrated embodiment, the damper 128 is disposed between the air inlet 112 and the duct 120. This positioning of the damper 128 can prevent warm air in the attic 110 from transferring heat to the living area 220 when the whole house fan 104 is off. For example, convective heat transfer from the attic 110 to the living space 220 can be reduced by scaling the damper 128 so that air does not flow from the attic 110 into the living space 220. Conductive heat transfer through the damper 128 can be reduced by making the damper 128 from a material with a low thermal conductivity. Additionally, the duct 120 can be insulated to reduce the warm air in the unvented attic 110 from warming the air within the duct 120. Because conductive heat transfer is driven by temperature gradients, reducing the temperature of the air within the duct 120 will reduce the conductive heat transfer across the damper 128.

In some embodiments, the whole house fan 104 is positioned partially or completely outward of the air-impermeable insulation 234 that is applied to the roof sheathing of the building structure 100. In some variants, the whole house fan 104 is positioned completely within the attic 110. For example, the whole house fan 104 can be disposed within a portion of the vent 114 that extends inward of the air-impermeable insulation 234. As discussed, the damper 128 can be configured to open when the whole house fan 104 is turned on. When the damper 128 is open, the cooling system 102 can provide an airflow pathway for the whole house fan 104 to draw air from the living space 220 and discharge air directly to the outside environment 440. The whole house fan 104 pulls air from the living space 220 through the air inlet 112, through the damper 128, through the duct 120, and through the whole house fan 104. The whole house fan 104 then pushes the air through the outlet 115 of the vent 114. When the whole house fan 104 is off, the damper 128 can move to the closed position, thereby preventing outside air from moving into the building structure.

With continued reference to FIG. 4, the damper 128 can be disposed in locations other than between the air inlet 112 and the duct 120. In certain variants, the damper 128 can be disposed partially or completely within the duct 120. In some configurations, the damper 128 is disposed within the vent 114 upstream of the whole house fan 104. In some variants, the cooling system 102 includes a plurality of dampers 128 disposed in one or more of the aforementioned locations.

Figure 5:
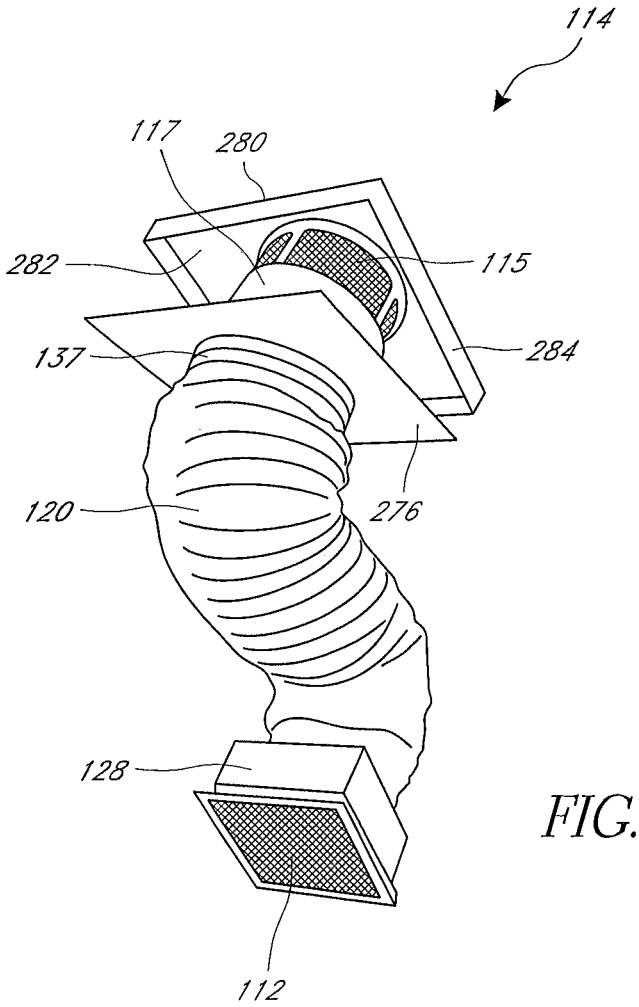
FIG. 5 depicts an embodiment of an air inlet, duct, and vent assembly of the present disclosure.

FIG. 5 shows a non-limiting embodiment of a vent 114 assembly for the fresh-air cooling system 102 depicted in FIG. 4. The duct 120 connects the air inlet 112 to the vent 114. The damper 128 is disposed between the duct 120 and the air inlet 112. In the shown embodiment, the vent 114 is coupled to a flange 276 that helps seat the vent 114 on the roof of the building structure 100, as described below. Although not visible in FIG. 5, the whole house fan 104 is located within a motor housing 117, which is adjacent to the flange 276 in the illustrated embodiment.

As shown in FIG. 5, the vent 114 can include a cap 280. The cap 280 can be configured to allow air to exit the vent 114 while preventing rain or debris from entering the vent 114. For example, the cap 280 can have a tented portion 282 that extends radially beyond the outlet 115 of the vent 114. The cap 280 can include a lip 284 that extends from the tented portion 282 toward the flange 276. In this way, the tented portion 282 and the lip 284 can form an umbrella-like structure that prevents water from flowing into the outlet 115 of the vent 114. The outlet 115 can be covered by a screen or grill that prevents debris, insects, or animals from entering the vent 114 through the outlet 115.

As shown, the cap 280 can be angled relative to the flange 276. In some embodiments, the cap 280 is angled relative to the flange 276 so that when the flange 276 is flush with a sloped roof, the cap 280 is inclined at a steeper angle than the roof. In other words, the gap between the cap 280 and the roof increases in the direction of the apex of the roof. The angle of the cap 280 can be selected so that the cap 280 obscures the vent 114 when viewed from the street level. The top surface of the cap 280 can be coated with a material that reflects incident radiative heat. As described in more detail below, the cap 280 can be fitted with a removable cover that matches the roof of the building structure, making the cap 280 less noticeable. In some embodiments, the cap 280 is configured to provide a lower resistance to the airflow through the outlet 115. For example, the angle between the lip 284 and the tented portion 282 can be increased for the portion of the lip 284 that is closest to the apex of the roof, thereby lowering the airflow back pressure on the outlet 115 while maintaining protection of the vent from debris and water.

Figure 6:
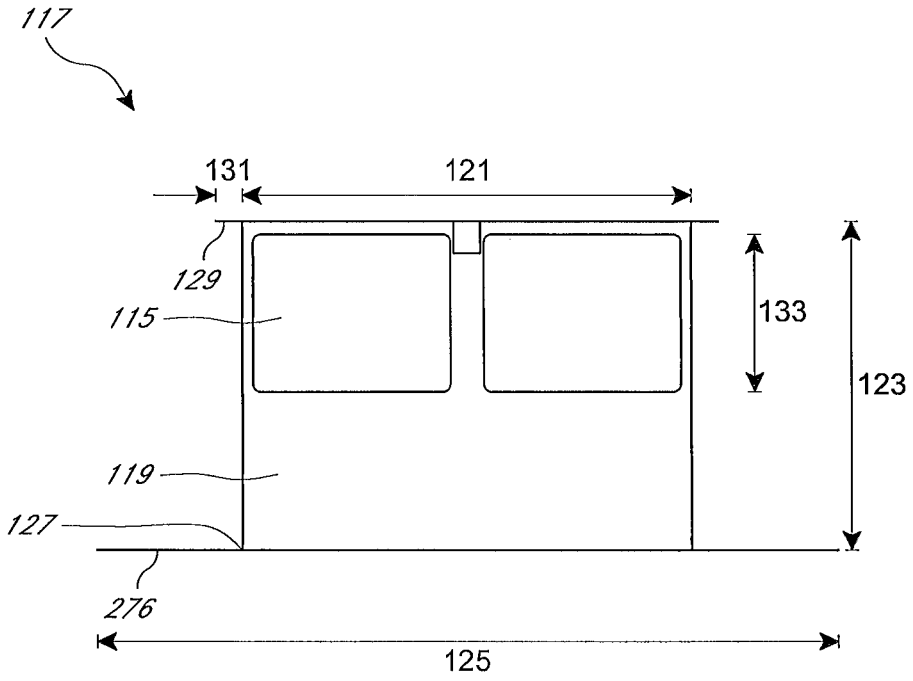
FIG. 6 depicts an embodiment of a motor housing.

FIG. 6 shows a non-limiting, illustrative embodiment of the motor housing 117 portion of the vent 114. In some embodiments, the motor housing 117 surrounds a whole house fan 104. In certain variants, the motor housing 117 surrounds a power ventilator 244 (e.g., attic fan). The motor housing 117 can have a body portion 119 that has one or more outlets 115 through which air can exit the motor housing 117 to reach the outside environment. In the illustrated embodiment, the body portion 119 is circular and has a diameter 121 of about 14½" and a height 123 of about 10½". One end of the body portion 119 can be attached to a flange 276. In the illustrated embodiment, the flange 276 is square and has a side length 125 of about 24 inches. The interface between the flange 276 and the body portion 119 can comprise a watertight seal 127. As mentioned above, the flange 276 can help secure the body portion 119 to the roof of the building structure 100. The watertight seal 127 can prevent water from penetrating the roof of the building structure 100. The end of the body portion 119 that is opposite of the flange 276 can include a rim 129, as shown in FIG. 18. The rim 129 extends a distance 131 radially beyond the body portion 119 of the motor housing 117. In the illustrated embodiment, the distance 131 is about ½". As mentioned above, the body portion 119 can include one or more outlets 115. In the illustrated embodiment, the outlets 115 have a longitudinal dimension 133 of about 5 inches and extend about ¼ of the circumference of the body portion 119. The outlets 115 can be covered by a screen mesh. In some variants, the outlets 115 are covered by a ¼" screen mesh.

Figure 7:
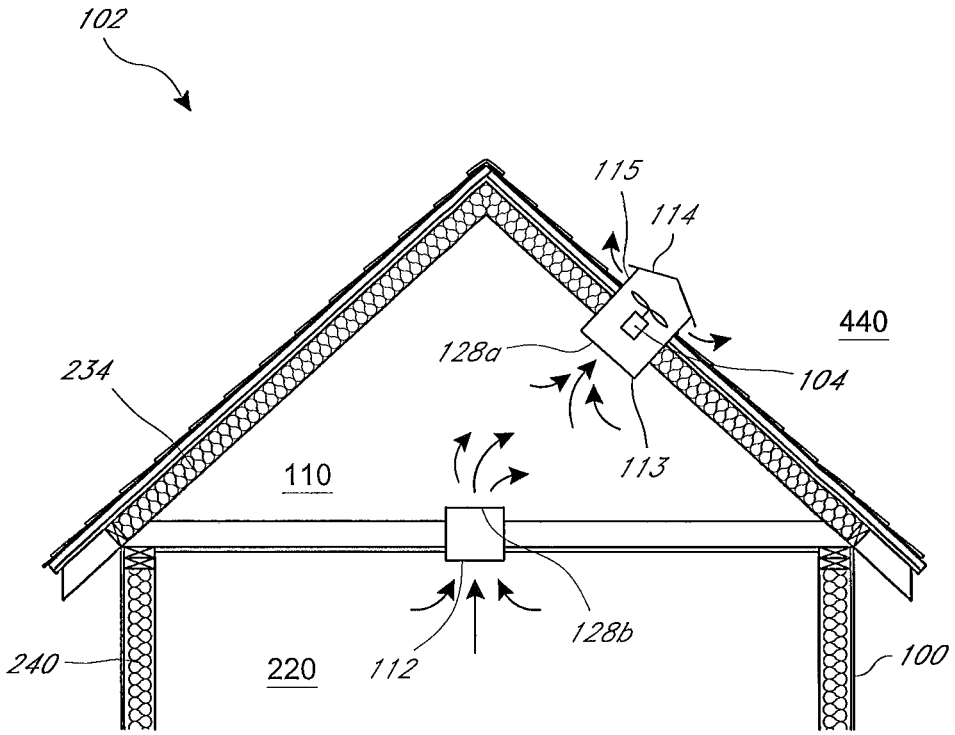
FIG. 7 is a schematic illustration of an embodiment of the cooling system of the present disclosure.

FIG. 7 shows another embodiment of the fresh-air cooling system 102 configured for use in a building structure 100 having an unvented attic 110. In the illustrated embodiment, the vent 114 is not connected to the air inlet 112 by a duct 120. This allows the air in the unvented attic 110 to join the airflow pathway that the fresh-air cooling system 102 establishes from the living structure 220 to the outside environment 440. As discussed above, drawing air from the unvented attic 110 can reduce solar heating of the attic air and heat conduction to the living space 220 the floor of the attic and the ceiling of the living space 220. The illustrated embodiment has a first damper 128*a* configured to seal the vent 114 when the whole house fan 104 is not in use, thereby preventing warm outside air from entering the unvented attic 110 and/or cool attic air from escaping the building structure 100. The fresh-air cooling system 102 has a second damper 128*b* configured to seal the air inlet 112, thereby preventing warm attic air from entering the living space and/or cool air from the living space 220 from entering the unvented attic 110.

In the illustrated embodiment, a first damper 128*a* controls airflow through the vent 114. The vent 114 has an inlet 113 that is positioned within the attic 110 and an outlet 115 that is disposed outside of the roof 242. The first damper 128*a* can move between an open configuration, in which air can flow through the vent 114, and a closed configuration, in which air flow through the vent 114 is restricted. In some variants, the fresh-air cooling system 102 can include a second damper 128*b* that controls air flow through the air inlet 112. The vent 114 and/or the air inlet 112 can have a cross-sectional area of between about 1 sqft. to about 16 sqft.

Figure 8:
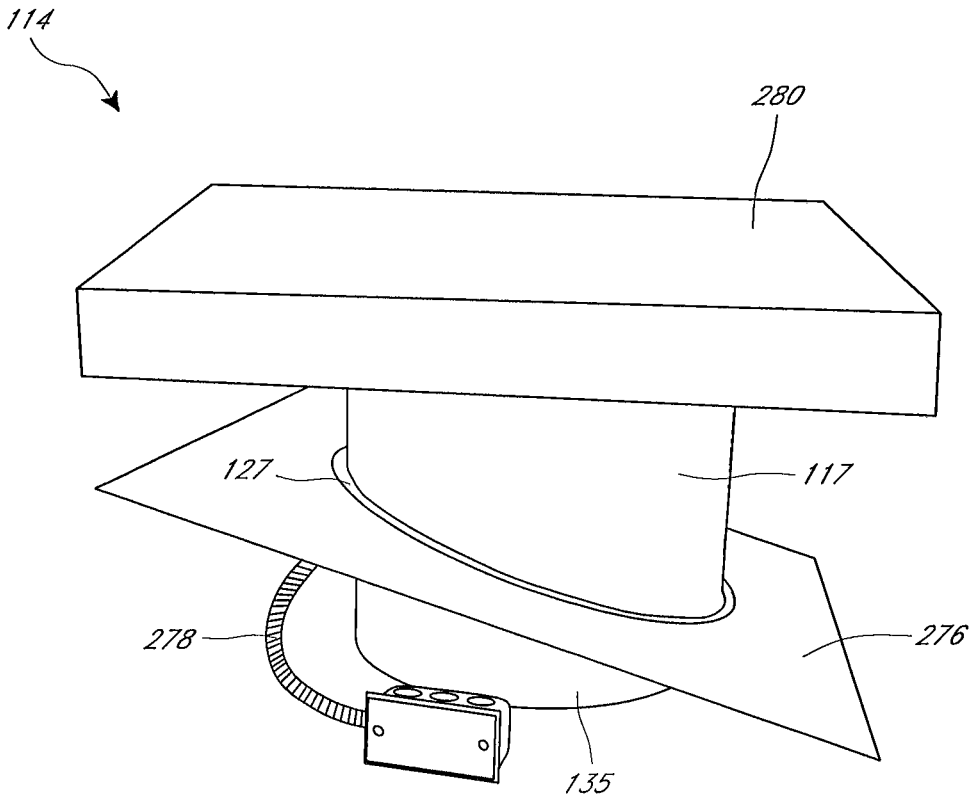
FIG. 8 is an embodiment of a vent assembly of the present disclosure.

FIG. 8 shows a non-limiting, illustrative embodiment of the vent 114 that can be used in the cooling system depicted in FIG. 7. The vent 114 has a motor housing 117, a flange 276, and a cap 280, as described above. The vent 114 can include an electrical conduit 278 for providing electrical current to power the whole house fan 104 or power ventilator 244 that is housed inside the motor housing 117. The base portion 135 of the motor housing 117 can be configured to couple to a damper 128 (not shown). For example, the base portion 135 can be sized to fit into the opening 252 (shown in FIG. 2) of a damper 128. In some embodiments, the base portion 135 can be sized to fit inside of the duct 120, as shown in FIG. 5. With continued reference to FIG. 5, the duct 120 can be sealed to the base portion 135 by a collar 137 that prevents air from passing between the inner surface of the duct 120 and the outer surface of the base portion 135. The collar 137 can be an adhesive tape, a tightening band collar, or other suitable means known in the art.

Figure 9:
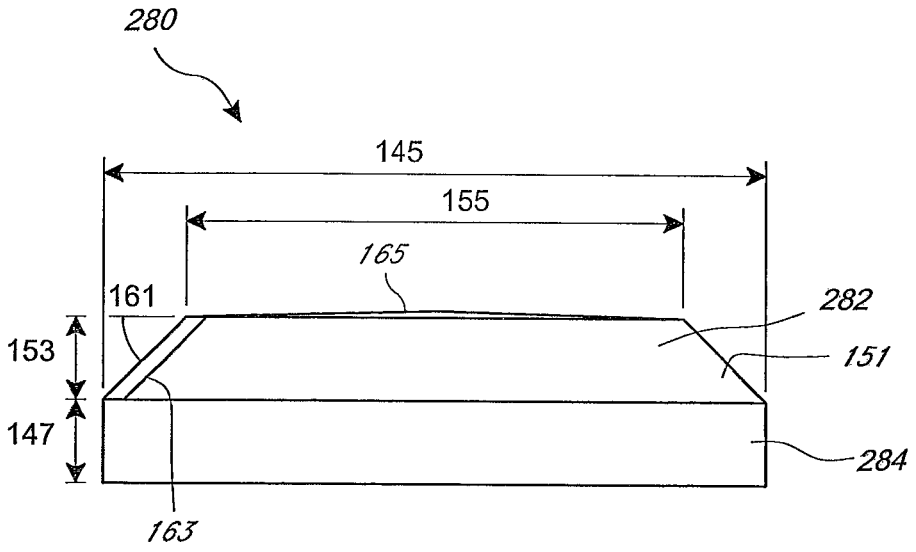
FIG. 9 depicts an embodiment of a removable cover.

FIG. 9 depicts an embodiment of a removable cover 280 that can be attached to the top portion of the vent 114. In the illustrated embodiment, the cover 280 tapers in the direction away from the roof of the building structure 100. In the shown embodiment, the base portion 284 of the cover 280 is square and has a side length 145 of about 24 inches and a height 147 of about 3 inches. The cover 280 can have other shapes and/or dimensions. In the illustrative embodiment, the top portion 282 of the cover 280 is square and has side panels 151 that are trapezoidal. The side panels 151 have a height 153 that is about 3 inches. The side panels 282 have a top length 155 that is about 18 inches. The side panels 282 can slope toward the base portion 284 at an angle 161, as shown in FIG. 9. In the illustrated embodiments, the angle 282 is about 45°. The side panels 149 can be attached to one another along a seam 163. The seam 163 can be watertight. The cover 280 can have a top surface 165. In some embodiments the central portion of the top surface 165 is tented relative to the radially outward portions of the top surface 165, forming a crown. In the illustrated embodiment, the crown has a height of about ¼".

Figure 10:
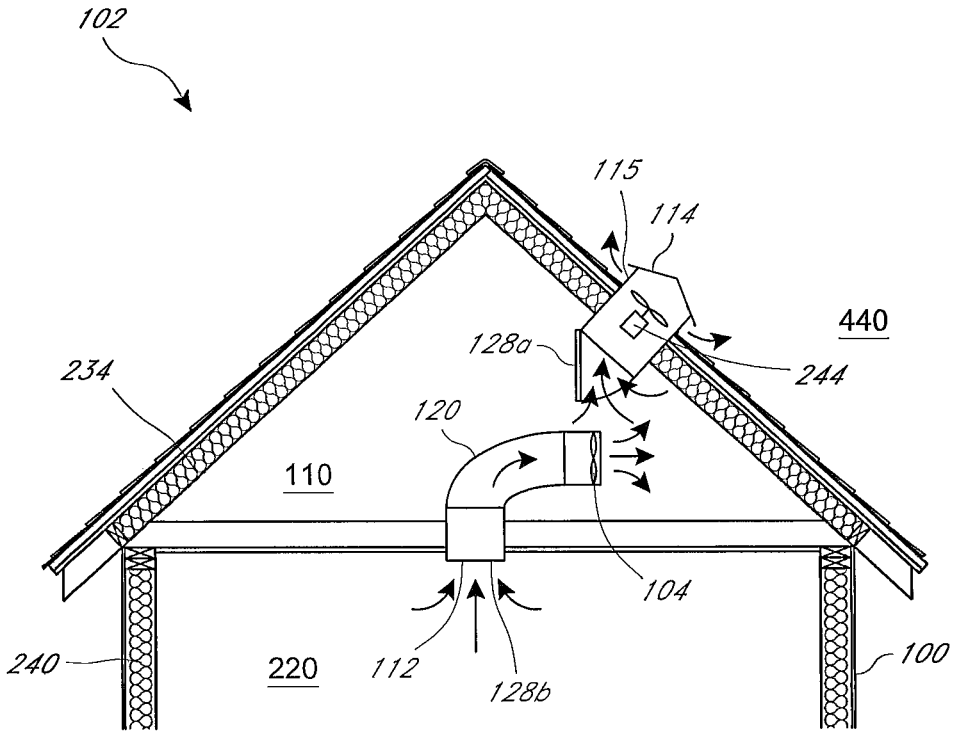
FIG. 10 is a schematic illustration of an embodiment of the cooling system of the present disclosure.

FIG. 10 shows another embodiment of the fresh-air cooling system 102 for use in a building structure 100 having an unvented attic 110. In the illustrated embodiment, the cooling system 102 has a power ventilator 244 within a vent 114 that has a damper 128*a*. The damper 128*a* controls access of the air in the attic 110 to the vent 114. When the cooling system 102 is running, the damper 128*a* opens to allow the power ventilator 244 to help pull air out of the attic 110 and discharge the attic air to the outside atmosphere. The illustrated cooling system 102 also includes a whole house fan 104 that discharges into the attic 110. The whole house fan 104 is coupled to an inlet 112 by a duct 120, as described above. The cooling system 102 includes a second damper 128*b* that controls air flow from the living space 220 through the air inlet 112. In the illustrated embodiment, the second damper 128*b* is located near the ceiling of the living space 220. In some variants, the second damper 128*b* can be located near the inlet of the duct 120 or near the outlet of the duct 120. Additionally, the power ventilator 244 can be replaced with a whole house fan 104. As discussed above, the illustrated embodiment can include one or more features (e.g., an air intake 106 near the attic floor) that allow the fresh-air cooling system 102 to convert the unvented attic into a vented attic, at least temporarily, when the whole house fan 104 is not in use.

Figure 11:
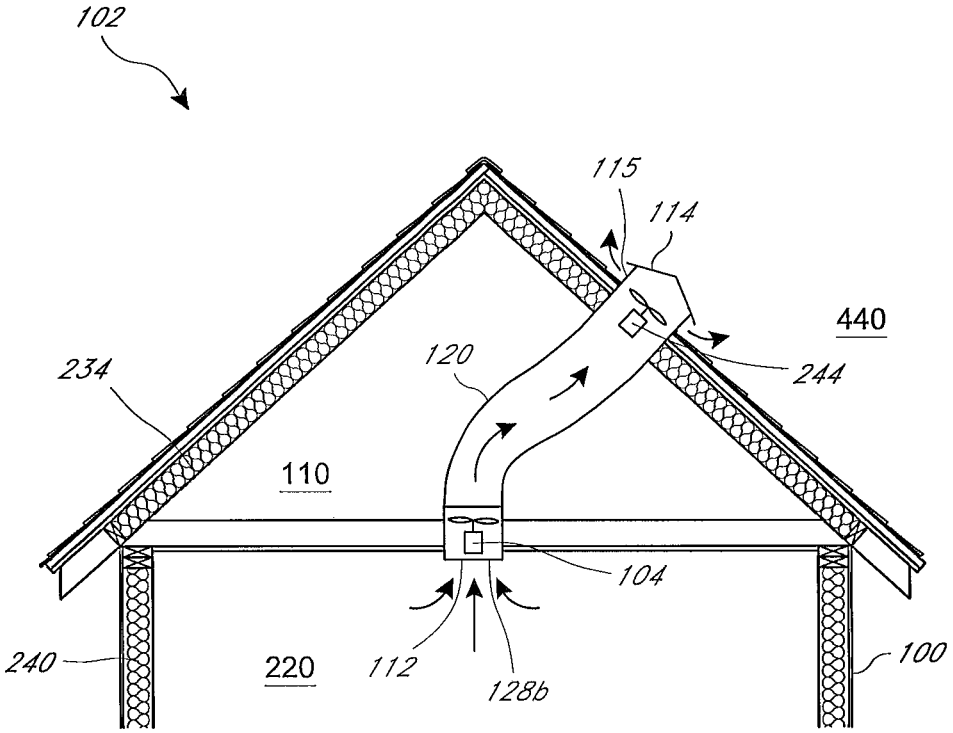
FIG. 11 is a schematic illustration of an embodiment of the cooling system of the present disclosure.

FIG. 11 shows another embodiment of the fresh-air cooling system 102 for use in a building structure 100 having an unvented attic 110. In the illustrated embodiment, the cooling system 102 has a whole house fan 104 that is positioned at or near the floor of the attic 110. The cooling system 102 has a damper 128 that controls air flow through the air inlet 112 to the whole house fan 104. The whole house fan 104 discharges into an insulated duct 120 that communicates with a vent 114 having an outlet 115 disposed outside of the building structure 100. The vent 114 houses a power ventilator 244 that can help draw the air out of the building structure 100. In some variants, the power ventilator 244 in the vent 114 can be replaced with a whole house fan 104.

Additionally, the cooling system 102 can include a second damper 128*b* (not shown) that is interposed between the vent 114 and the duct 120, thereby preventing outside air from entering the duct 120 when the cooling system 102 is not on. As discussed in regard to the embodiment of FIG. 10, the illustrated embodiment can include one or more features (e.g., an air intake 106 near the attic floor, a vent 114 near the apex of the roof 242) that allow the cooling system 102 to convert the unvented attic 110 into a vented attic, at least temporarily, when the whole house fan 104 is not in use.

Figure 12:
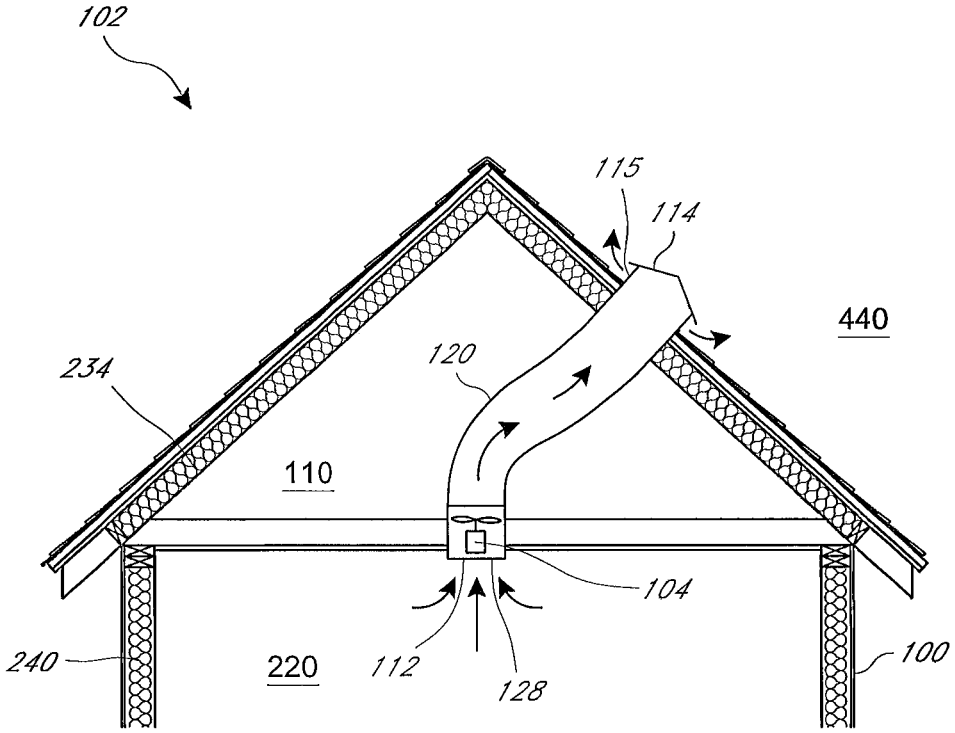
FIG. 12 is a schematic illustration of an embodiment of the cooling system of the present disclosure.

FIG. 12 shows another embodiment of the fresh-air cooling system 102 for use in a building structure 100 having an unvented attic 110. In the illustrated embodiment, the cooling system 102 has a whole house fan 104 positioned at or near the floor of the attic 110. A damper 128 near the air inlet 112 controls the flow of air from the living space to the inlet of the whole house fan 104. The whole house fan 104 discharges into an insulated duct 120 that is connected to a vent 114 having an outlet 115 positioned above the roofline of the building 100. As discussed in regard to the embodiment of FIG. 11, the illustrated embodiment can include one or more features (e.g., an air intake 106 near the attic floor, a vent 114 near the apex of the roof 242) that allow the cooling system 102 to convert the unvented attic into a vented attic when the whole house fan 104 is not in use.

When the whole house fan 104 is off, the cooling system 102 can be configured to close the first damper 128*a*, thereby reducing airflow and convective heat transfer from the outside environment 440 to the attic 110. The first damper 128*a* can be thermally insulated, as discussed above, to reduce heat transfer by conduction from the roof 242 and/or the outside environment 440 to the attic 110 through the damper 128*a*. In some embodiments, the first damper 128*a* can be configured to have an R-value that is equal to or greater than the R-value of the air-impermeable insulation 234 when the first damper 128*a* is in the closed position.

In some embodiments, the fresh-air cooling system 102 can include more than one vent 114. In certain variants, the fresh-air cooling system 102 includes a plurality of vents 114, with each vent 114 having its own damper 128. In some configurations, the cooling system 102 can have a plurality of vents 114 that communicate with a common channel (not shown). The common channel can be interposed between the plurality of vents 114 and the attic 110. The common channel can have a damper 128 that controls air flow between the attic 110 and the plurality of vents 114. One or more of the plurality of vents 114 can include a damper 128 that controls flow between the common channel and an individual vent 114 of the plurality. As mentioned above, the operation of the dampers 128 can be controlled and/or coordinated by an integrated thermostat 400.

Figure 13:
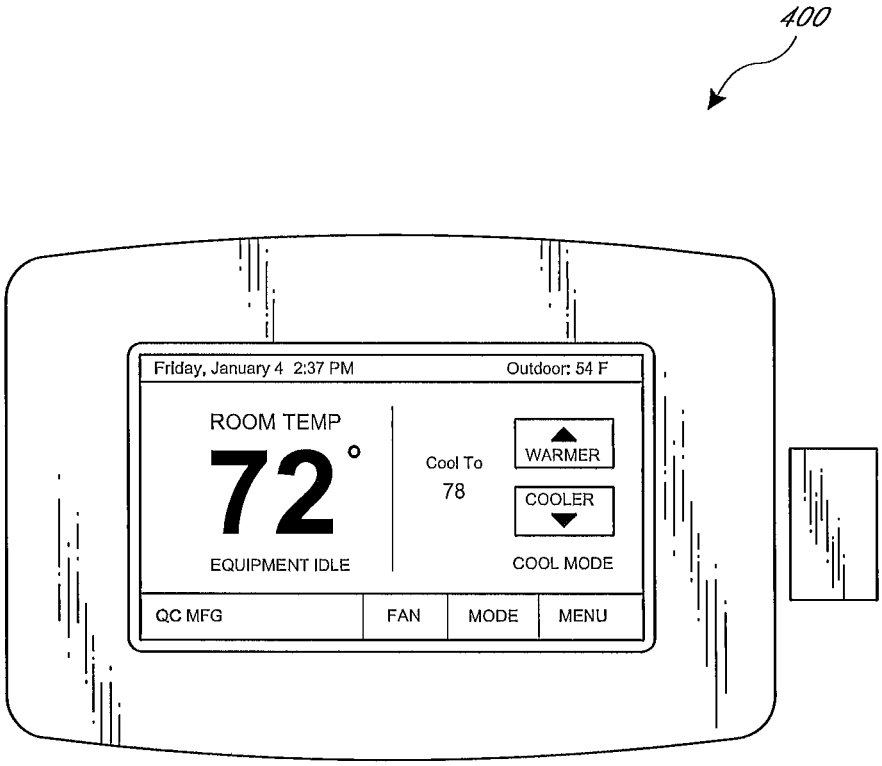
FIG. 13 depicts an embodiment of an integrated thermostat.

FIG. 13 depicts an embodiment of an integrated thermostat 400. The thermostat 400 can be an electronic control switch that controls the cooling and ventilation and humidity systems in a building. The integrated thermostat 400 can be in communication with an air intake 106 system, a whole house fan 104 system, and if present, an air conditioning system to fully optimize air control throughout the building structure 100, while reducing the overall energy output of the building structure 100. In some embodiments, the integrated thermostat 400 can be in communication with the motors of the air intake 106 system to activate the dampers 128. Also, as described above, the motors and/or dampers 128 can include position information sent to the integrated thermostat 400. As described in detail below, the integrated thermostat 400 can open and close the air intake 106, turn on and off the whole house fan 104 system, open and close the external air vent 114, and turn on and off the air conditioning system without any user input. Therefore, the entire cooling and ventilation system can be completely automated.

The use of the mechanical dampers 128 described above can create a controlled mechanical attic ventilation (CMAV), or airflow system 103. In some embodiments, the whole house fan 104 and the CMAV 103 can be wired directly together. In some embodiments, the whole house fan 104 and the CMAV 103 can be in communication with one another wirelessly. In some embodiments, the whole house fan 104 and the CMAV 103 can be in communication indirectly with one another through a different system. In some embodiments, the vents 114 can be electrically and/or electronically opened. In some embodiments, a controller can be used to open and close the mechanical dampers 128. In some embodiments, the mechanical dampers 128 can be in communication with the whole house fan 104 to open and close. In some embodiments, the mechanical dampers 128 can provide for an airtight seal when closed. The mechanical dampers 128 can be controlled in tandem with the whole house fan 104, and thus can be synced with the whole house fan 104 in some embodiments.

Figure 14:
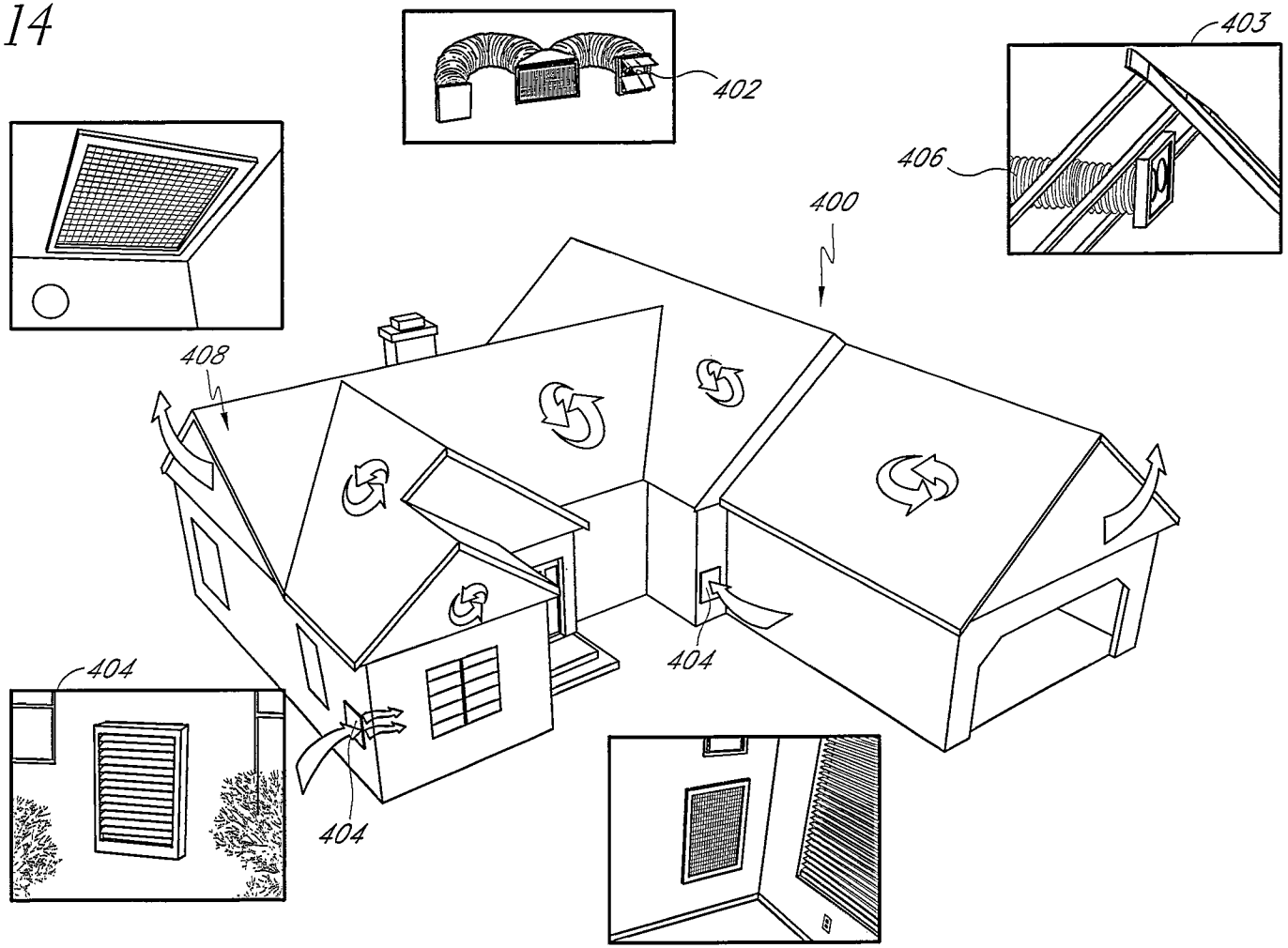
FIG. 14 is a partial schematic view of a building structure showing an air cooling system of another preferred embodiment of the present disclosure installed therein to cool the building structure.

FIG. 14 provides a partial sectional view of a building structure 400 showing a fresh-air air cooling system of one preferred embodiment of the present disclosure installed therein to cool the building structure having an unvented attic 110. In the embodiment shown in FIG. 14, the building structure 400 is a one-story residential house. In operation, a negative pressure or vacuum created by the fan assembly 402 (e.g., whole house fan 104, and/or power ventilator 244) draws outside air in through the evaporator systems 404 located adjacent various rooms inside the house, such as the living room and the bedroom. The evaporator system 404 cools the air by evaporation as it passes through the wetted media and into the living area. The air is drawn through the ceiling mounted ducts 406 and into the fan and expelled into the attic 408. The positive pressure created in the attic forces air to exit the attic through venting vent system and substantially inhibit outside air from entering the attic through the vent system, e.g. intake or exhaust. In some embodiments, a thermostat or switch can be used to turn on or off the fan assembly to maintain a constant temperature in the home. In one implementation, the thermostat is adapted to turn evaporator system pump on when the temperature inside the building structure has reached a preset level, and to turn the evaporator system pump off when the temperature inside the building structure has dropped back down below a preset level. In one implementation, the thermostat is electronically wired to turn on the evaporator system pump when the temperature inside the living area reaches about 75 degrees F. and to turn off the pump when the temperature inside the living area drops down to about 72 degrees F.

As also shown in FIG. 14, the air cooling system can be positioned to regulate cooling of individual rooms of the house. The system can include a control mounted on the wall of each room of the house. The control can be a wall mounted toggle or timer switch and the like. The fan systems for each individual room can be turned on or off, thereby providing the capability of controlling the cooling of individual rooms. In some embodiments, the system utilizes a single large fan, having an airflow capacity of between about 2750 cfm to 8000 cfm. In other embodiments, the system can include a plurality of smaller fans, each having an air flow capacity of about 1500 cfm. In operation, when the system 200 is turned off for a particular room, the gravity operated damper closes off the duct to substantially prevent air in the attic from entering the living area and substantially reduce the transfer of heat or cold into the living area through radiation.

The air cooling system of certain preferred embodiments is capable of reducing the outside temperature by about 40° F. Unlike conventional air conditioners which recirculate air inside a building structure, the air cooling system of preferred embodiments is capable of exchanging the indoor air with clear fresh air, preferably 3 to 4 times per minute for a 2000 square foot house, while also cooling the air inside. Unlike conventional swamp coolers which tend to introduce excessive moisture into the dwelling, the air cooling system of the preferred embodiments is capable of cooling the interior of a building structure while leaving the interior air at a humidity level of about 45%-60%. Further, the novel design of the air cooling system is configured to create a positive pressure environment inside the attic, which forces the warm air to be expelled from the attic through all open vents in the attic. In preferred embodiments, the air cooling system is capable of reducing the attic temperature by as much as 50° F. Additionally, during operation, the system operates more quietly than prior art systems with equivalent cooling effectiveness. In certain preferred embodiments, during operation, the sound level generated by the system in the living area is between about 0.4 to 0.6 sones.

Advantageously, the air cooling system utilizes an energy efficient evaporator similar to swamp coolers or evaporative coolers, however the evaporative system is configured in a small attractive protrusion on the exterior of the house wherein the typical evaporative cooler is large, un-attractive box shaped appliance attached to the exterior. Another advantage is that the multi-fan system allows individual rooms to be cooled or not cooled depending on which fan is turned on or off. Another advantage is that the cooling system provides effective cooling inside both the living area as well as the attic area of a building structure. Another advantage is that the cooling system is capable of exchanging the air inside a building structure with fresh air while maintaining effective cooling. Another advantage is that the cooling system operates more quietly than other evaporative cooling systems with equivalent cooling effectiveness.

In some embodiments, a power attic ventilator 244 can be used in order to move air out of the building structure 100. The power attic ventilator 244 could be, for example, a fan mounted cylinder that could mount to the dampers 128. The ventilator 244 can then be used to blow or suck air out of the building 100, thereby improving temperature change rates in the building 100. In some embodiments, the ventilator 244 can be an attic fan. In some embodiments, the flow rate of the ventilators 244 can be approximately the same as the flow rate of the whole house fan 104. In some embodiments, the ventilators 244 can be located outside or inside the roof line.

In some embodiments, a power attic ventilator 244 may not be used. If a ventilator 244 is not used, a larger attic exit point (and thus larger or more mechanical dampers 128) would likely be used in order to properly regulate temperature in the building 100. In some embodiments, the use of the ventilators 244 can allow for more square footage of the roof to be covered with solar panels.

There are many advantages to using a whole house fan 104 with a roofline insulated building rather than an attic floorline insulated building. For example, a building can experience significant energy savings as an unvented attic can be warmer in the winter and cooler in the summer. This can reduce overall HVAC load. Further, by insulating the whole of the attic 110, the equipment can last longer as it is less likely to experience environmental hazards.

Further, by insulating the attic 110, the buildings moisture resistance can be improved. The attic 110 can stay drier than floorline insulation attics, and thus can reduce or avoid problems with mold and wood rot.

Moreover, roofs having unvented attics are less likely to be blown off by high winds, such as tornadoes, as wind has less access to the inside of the attic. Further, as there are no vents into the attic, fire hazards from floating embers are generally diminished. In addition, in coastal climates, the unvented attics can keep out salt spray and rain, thus reducing corrosions and other damages.

In some embodiments, the fresh air cooling system 102 of the present disclosure can be used in conjunction with an air conditioning system. The integrated thermostat 400 can automatically determine optimal utilization of the air conditioning system by preferring the fresh air cooling system 102 over the air conditioning system. When the external temperature is at or below the internal temperature and the integrated thermostat 400 calls for cooling, the thermostat 400 can activate the fresh air cooling system 102 and can turn off the air conditioner. When the external temperature is above the internal temperature and the thermostat calls for cooling, the integrated thermostat 400 can automatically deactivate the fresh air cooling system 102 and can turn on the air conditioner. In some embodiments, the integrated thermostat 400 can include error correction features such that the air conditioning system cannot be turned on when the thermostat detects that the fresh air cooling system 102 is active. Conversely, in some embodiments, the fresh air cooling system 102 will not activate when the thermostat detects that the air conditioning system is activated. In some embodiments, the integrated thermostat 400 also will not allow the whole house fans 104 to activate unless the air intakes 106, vents 114, and dampers 128 are in their open positions.

The automated fresh air cooling system 102 can have the flexibility to be installed in several different HVAC building environments to provide an energy savings and cost savings. For example, embodiments of the disclosed automated fresh air cooling system 102 can be installed in a building 100 without an air conditioning system, retrofitted to be installed in a building 100 with an existing air conditioning system, or installed as part of an air conditioning system installation.

Embodiments of the disclosed automated fresh-air cooling system 102 may require only a fraction of the energy of the air conditioning system and therefore can result in a significant energy and cost savings compared to traditional air conditioning systems by reducing the demand of the air condition system. Further, a user is not required to open the air intake, and the thermostat can seamlessly switch between the fresh air cooling system and an air conditioning system when present.

As discussed above, the fresh-air cooling systems 102 can include an integrated thermostat 400. In some embodiments, the integrated thermostat 400 can be coupled with one or more temperature and/or humidity sensors to make fine-tuned control decisions. Temperature and/or humidity sensors can be placed both inside the building structure and outside in the ambient environment to determine optimal conditions for activating the whole house fan system.

In some embodiments, the integrated thermostat 400 can include a touch-screen interface for programming the device. In some embodiments, the integrated thermostat 400 can also be used to control other secondary automated building functions such as security, lighting, and major appliances. In some embodiments, the integrated thermostat 400 can be used to control heating in a manner similar to the air conditioning system. In some embodiments, the integrated thermostat 400 can be activated remotely via a cellular telephone or by personal computer. In some embodiments, a user can determine the existing indoor temperature, outdoor temperature and humidity, and presently active units from a remote location through remote communication with the integrated thermostat. A user can also use the remote function to make program or control changes in the cooling and ventilation system. In some embodiments, the integrated thermostat 400 can be coupled with energy load sensors to provide an energy management report and energy efficiency recording of the building. In some embodiments, the energy load sensors can be placed on major appliances, the fresh air cooling system, and the air conditioning system to provide instantaneous energy reports.

As should be appreciated by one skilled in the art, the fresh air cooling system has the flexibility to be installed in several different HVAC building environments to provide an energy savings and cost savings. In some embodiments, the fresh air cooling system 102 can be installed in a building without an existing air conditioning system. In such an installation, the integrated thermostat 400 can make control decisions on whether to activate the fresh air cooling system based on the external and internal building temperature and/or humidity conditions. In some embodiments, the fresh air cooling system 102 can be retrofitted to a building with an existing air conditioning system. In such an installation, the integrated thermostat 400 can use the internal and external temperature and/or humidity sensors to make control decisions about whether to activate either the fresh air cooling system or the existing air conditioning. As described in detail with respect to the control algorithm, the system can activate the fresh air cooling system over the existing air conditioning whenever the ambient temperature and humidity conditions allow in order to realize a cost and energy savings over running the air conditioner. In some embodiments, the fresh air cooling system can be installed in a building as part of a new air conditioning installation. In such an installation, the integrated thermostat functions substantially the same as in installations retrofitted to function with existing air conditioning systems.

In some embodiments, the fresh air cooling system 102 can make control decisions based on interior and exterior atmospheric conditions provided by the internal and external temperature and/or humidity sensors. The typical operation of the system in a home that does not have air conditioning is for the thermostat 400 to turn on or off the whole house fans 104 depending on the desired temperature setting on the integrated thermostat 400. If the integrated thermostat 400 calls for cooling, the thermostat 400 can determine whether the outside air temperature is cooler than the inside and then opens the damper 128 and turns on the fan 104 or fans. If the outside temperature is warmer than the internal temperature, the thermostat 400 does not activate the system 102 but can continue to monitor the situation periodically until the outside temperature is cool enough to be brought in effectively. In some embodiments, the thermostat 400 can be conditioned to control based on the measured humidity sensors.

In some embodiments, the thermostat 400 can control the air conditioner as well as the fresh air cooling system 102. If the integrated thermostat 400 calls for cooling, the integrated thermostat 400 first can consider whether the fresh air cooling system 102 has the capacity to efficiently cool the house. The integrated thermostat 400 can be set to default to use the fresh air cooling system 102 whenever possible instead of the air conditioning system to provide a cost savings. If the integrated thermostat 400 determines that the fresh air cooling system 102 can effectively cool the building structure 100, the thermostat 400 can activate the fresh air cooling system 102 until the desired temperature is reached. If, while the whole house fans 104 are running, the thermostat 400 determines that the fans 104 are providing inadequate cooling and cannot cool the house to the desired temperature, it can turn off the fans, can close the air intake 106, can close the vents 114, and can turn on the air conditioner. It then can continue to monitor the situation and can turn off the air conditioner and turn back on the whole house fans 104 when conditions are optimal for the fresh air cooling system 102.

In some embodiments, the integrated thermostat 400 can include error correction features such that the air conditioning system cannot be turned on when the thermostat detects that the air intakes are open, the vents are open and the whole house fans are activated. Conversely, in some embodiments, the fresh air cooling system 102 will not activate when the thermostat 400 detects that the air conditioning system is activated. In some embodiments, the integrated thermostat 400 also will not allow the whole house fans 104 to activate unless the air intakes 106 and vents 114 are in their open positions.

In some embodiments, the recommended usage in the summer season is to turn on the fresh air cooling system 102 when the outside temperature is equal to or below the inside temperature and then keep them on until late in the evening to remove most of the latent heat that is in the structure and mass of the house and the attic 110. In some embodiments, the system can be kept on until three hours after sunset. In some embodiments, the system can be kept on all night long. This method can prolong the cooling effects of the fresh air cooling system 102 into the subsequent day, thus reducing demand of the air conditioner. By following this procedure, a typical house in a desert climate zone, such as in the inland empire in southern California, may only require that the air conditioner be run for two to three hours per day instead of the normal 8 to 10 hours in the heat of the summer typically required by existing air conditioning systems. The fresh air cooling system 102 can require only a fraction of the energy of the air conditioning system, and therefore results in a significant energy and cost savings compared to traditional air conditioning systems.

Utilizing multiple air intakes 106, the system 102 can be constructed with multiple zones whereby each air intake 106 can operate over different rooms or regions of the occupied space. When multiple air intakes 106 are used in conjunction with multiple thermostats, temperature sensors and/or humidity sensors, a user can activate different zones at different times to cool the home. Such a system allows for cooling of only the occupied rooms of the building structure therefore providing for more efficient cooling of the space and less energy consumption. Unoccupied rooms can be turned off or ignored by the control system.

Utilizing an automated air intake system in conjunction with the whole house fan 104 and vent system can enable intelligent air quality and comfort level control. The system can automatically determine when to open and close the intake 106 and vent 114 and turn on the whole house fan 104 when the exterior conditions permit cooling of the internal building structure. The user does not have to manually open windows to serve as air intakes and the building can be more effectively cooled with automated control. Additionally, the system 102 can operate when the user is away from the building. The thermostat 400 can open or close the damper 128 and ascertain that the fans 104 do not run until the damper 128 is open. At the same time, the damper's filters can clean all incoming air. Utilizing the fresh air cooling system 102 in conjunction with an air conditioning system can allow for an energy savings and a cost savings by reducing the demand of the air condition system. The integrated thermostat 400 can activate the fresh air cooling system 102 whenever the temperature and/or humidity sensors detect optimal cooling conditions. The user is not required to open the air intake 106 and the thermostat 400 can seamlessly switch between the fresh air cooling system 102 and an air conditioning system when present.

From the foregoing description, it will be appreciated that embodiments of an inventive cooling system are disclosed. While several components, techniques and aspects have been described with a certain degree of particularity, it is manifest that many changes can be made in the specific designs, constructions and methodology herein above described without departing from the spirit and scope of this disclosure.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than or equal to 10% of, within less than or equal to 5% of, within less than or equal to 1% of, within less than or equal to 0.1% of, and within less than or equal to 0.01% of the stated amount.

Some embodiments have been described in connection with the accompanying drawings. The figures are drawn to scale, but such scale should not be limiting, since dimensions and proportions other than what are shown are contemplated and are within the scope of the disclosed inventions. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps. For example, some attics have not only sloping roofs, but also vertical walls that enclose the attic 110. In attics that have a vertical wall or gable end, the vent 114 of the system according to certain embodiments of the present disclosure can also be placed in the vertical wall.

While a number of embodiments and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

What is claimed is:

1. A ventilation system for a building having an attic, the system comprising:

a vent configured to be disposed on a roof of the building and configured to provide airflow between the attic and an environment outside of the building;

an air inlet configured to be disposed on a wall of a living space of the building, the air inlet configured to provide airflow between the attic and the living space of the building;

an air opening configured to be disposed on an outside wall of the building, the air opening configured to provide airflow between the environment outside of the building and the living space of the building;

a duct configured to connect the vent and the air inlet, the duct configured to be sealed against the vent to inhibit air from passing between the duct and the vent into the attic, the duct configured to inhibit air from passing between the duct and the air inlet;

a whole house fan configured to operate at 200 to 4,000 revolutions per minute and to operate with a 500 to 8,000 cubic feet per minute capacity, the whole house fan configured to create airflow through the duct from the air inlet to the vent to create static negative pressure within the building to draw air from the environment outside of the building into the living space through the air opening; and an integrated thermostat configured to be in communication with the whole house fan and configured to turn on and off the whole house fan, the integrated thermostat configured to communicate with a temperature sensor placed inside the building, the integrated thermostat configured to communicate with a temperature sensor placed outside the building, the integrated thermostat configured to switch the system between a first airflow configuration and a second airflow configuration based at least in part on a temperature reading from the temperature sensor placed inside the building and a temperature reading from the temperature sensor placed outside the building, wherein in the first airflow configuration, the vent is closed and the air opening is open, and wherein in the second airflow configuration, the vent is open and the air opening is open.

2. The system of claim 1, further comprising a damper having a door or a blade configured to inhibit airflow through at least one of the vent, the air inlet, or the air opening.

3. The system of claim 2, further comprising a motor configured to move the door or the blade to allow or inhibit airflow through the at least one of the vent, the air inlet, or the air opening.

4. The system of claim 3, wherein the door or the blade configured to be moved by the motor is configured to inhibit airflow through the air opening.

5. The system of claim 2, wherein the door or the blade of the damper is configured to move to a closed position by gravity.

6. The system of claim 5, wherein the door or the blade configured to move to the closed position by gravity is configured to inhibit airflow through the air inlet.

7. The system of claim 1, further comprising a power ventilator configured to exhaust to the environment outside of the building a volume of air drawn from the living space, wherein the power ventilator is configured to be positioned within a motor housing between the duct and an outlet of the vent, wherein the whole house fan is configured to be disposed proximate the air inlet relative to the power ventilator.

8. The system of claim 1, wherein the wall on which the air inlet is disposed is a ceiling of the living space.

9. The system of claim 1, wherein the system is configured to operate with the attic being unvented and sealed from the environment outside of the building.

10. The system of claim 1, further comprising a motor housing configured to be positioned between the duct and an outlet of the vent, the whole house fan configured to be positioned within the motor housing.

11. The system of claim 1, wherein the air opening comprises an air intake, an evaporator, or a window.

12. The system of claim 1, wherein the air inlet comprises an air inlet damper configured to seal the air inlet.

13. The system of claim 12, wherein the air inlet damper comprises a plurality of blades configured to move to a closed position by gravity.

14. The system of claim 12, wherein the air inlet damper further comprises a switch sensor configured to indicate a position of the air inlet damper.

15. The system of claim 1, further comprising a flange disposed on an outer surface of the vent, the flange forming a substantially watertight seal with the vent and configured to position the vent relative to a roof of the building.

16. The system of claim 15, further comprising a cap disposed over an outlet of the vent, the cap being angled relative to the flange.

17. The system of claim 1, wherein the integrated thermostat is configured to activate the whole house fan based on an external temperature reading from the temperature sensor placed outside the building being less than an internal temperature reading from the temperature sensor placed inside the building.

18. A ventilation system for a building having an attic, the system comprising:

a vent configured to be disposed on a roof of the building and configured to provide airflow between the attic and an environment outside of the building;

an air inlet configured to be disposed on a wall of a living space of the building, the air inlet configured to provide airflow between the attic and the living space of the building;

an air opening configured to be disposed on an outside wall of the building, the air opening configured to provide airflow between the environment outside of the building and the living space of the building;

a duct configured to connect the vent and the air inlet, the duct configured to be sealed against the vent to inhibit air from passing between the duct and the vent into the attic, the duct configured to inhibit air from passing between the duct and the air inlet;

a whole house fan configured to operate at 200 to 4,000 revolutions per minute and to operate with a 500 to 8,000 cubic feet per minute capacity, the whole house fan configured to create airflow through the duct from the air inlet to the vent to create static negative pressure within the building to draw air from the environment outside of the building into the living space through the air opening; and a motor housing configured to be positioned between the duct and an outlet of the vent, the whole house fan configured to be positioned within the motor housing.

19. The system of claim 18, further comprising a damper having a door or a blade configured to inhibit airflow through at least one of the vent, the air inlet, or the air opening.

20. The system of claim 19, further comprising a motor configured to move the door or the blade to allow or inhibit airflow through the at least one of the vent, the air inlet, or the air opening.

21. The system of claim 20, wherein the door or the blade configured to be moved by the motor is configured to inhibit airflow through the air opening.

22. The system of claim 19, wherein the door or the blade of the damper is configured to move to a closed position by gravity.

23. The system of claim 22, wherein the door or the blade configured to move to the closed position by gravity is configured to inhibit airflow through the air inlet.

24. The system of claim 18, wherein the wall on which the air inlet is disposed is a ceiling of the living space.

25. The system of claim 18, wherein the system is configured to operate with the attic being unvented and sealed from the environment outside of the building.

26. The system of claim 18, wherein the air opening comprises an air intake, an evaporator, or a window.

27. The system of claim 18, wherein the air inlet comprises an air inlet damper configured to seal the air inlet.

28. The system of claim 27, wherein the air inlet damper comprises a plurality of blades configured to move to a closed position by gravity.

29. The system of claim 27, wherein the air inlet damper further comprises a switch sensor configured to indicate a position of the air inlet damper.

30. The system of claim 18, further comprising a flange disposed on an outer surface of the vent, the flange forming a substantially watertight seal with the vent and configured to position the vent relative to a roof of the building.

31. The system of claim 30, further comprising a cap disposed over an outlet of the vent, the cap being angled relative to the flange.

* * * * *